US009561404B2

(12) United States Patent
Aguinaldo et al.

(10) Patent No.: US 9,561,404 B2
(45) **Date of Patent: *Feb. 7, 2017**

(54) ADJUSTABLE GOLF CLUB SHAFT AND HOSEL ASSEMBLY

(71) Applicant: CALLAWAY GOLF COMPANY, Carlsbad, CA (US)

(72) Inventors: Homer E. Aguinaldo, Chula Vista, CA (US); Broadus Perry Wall, Jr., Carlsbad, CA (US); Denver Holt, Carlsbad, CA (US); James A. Seluga, Carlsbad, CA (US); Scott Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/861,990

(22) Filed: Sep. 22, 2015

(65) Prior Publication Data

US 2016/0008675 A1 Jan. 14, 2016

Related U.S. Application Data

(60) Division of application No. 14/223,594, filed on Mar. 24, 2014, now Pat. No. 9,168,427, which is a division of application No. 13/326,156, filed on Dec. 14, 2011, now Pat. No. 8,715,102, which is a

(60) Provisional application No. 61/452,521, filed on Mar. 14, 2011, provisional application No. 61/451,523, filed on Mar. 10, 2011.

(Continued)

(51) Int. Cl.

| | |
|---|---|
| ***A63B 53/02*** | (2015.01) |
| ***A63B 53/06*** | (2015.01) |
| ***A63B 71/06*** | (2006.01) |
| ***A63B 53/04*** | (2015.01) |
| ***A63B 59/00*** | (2015.01) |

(52) U.S. Cl.

CPC ..... *A63B 53/02* (2013.01); *A63B 53/0466* (2013.01); *A63B 53/06* (2013.01); *A63B 59/0074* (2013.01); *A63B 60/42* (2015.10); *A63B 71/06* (2013.01); *A63B 53/047* (2013.01); *A63B 53/0487* (2013.01); *A63B 2053/023* (2013.01); *A63B 2053/025* (2013.01)

(58) Field of Classification Search

CPC ... A63B 53/02; A63B 53/06; A63B 2053/023; A63B 71/06; A63B 53/0466; A63B 53/047; A63B 53/0487; A63B 60/42; A63B 59/0074; A63B 2053/025

See application file for complete search history.

(56) References Cited

U.S. PATENT DOCUMENTS 1,352,020 A * 9/1920 Olson ..... A63B 53/065 473/244
1,697,846 A * 1/1929 Anderson ..... A63B 53/06 473/246

(Continued)

*Primary Examiner* — Stephen Blau
(74) *Attorney, Agent, or Firm* — Rebecca Hanovice; Michael Catania; Sonia Lari

(57) ABSTRACT

An adjustable shaft and hosel assembly allows for dependent and independent adjustment of a golf club's face angle, loft angle, and lie angle. The adjustable shaft and hosel assembly comprises a shaft sleeve, a hosel portion, and a ball joint, wherein the ball joint is located either on the shaft sleeve or the hosel portion and fits within, and is rotatable along various axes within, a socket.

12 Claims, 14 Drawing Sheets

Related U.S. Application Data continuation-in-part of application No. 13/311,319, filed on Dec. 5, 2011, now Pat. No. 8,684,859.

(56) References Cited

U.S. PATENT DOCUMENTS 2,027,452 A * 1/1936 Gunnar Rusing ..... A63B 53/06 473/246
2,708,579 A * 5/1955 Hugman ..... A63B 53/0487 473/244
3,423,089 A * 1/1969 Andis ..... A63B 53/06 248/343
3,430,957 A * 3/1969 Andis ..... A63B 53/065 248/343
4,073,492 A * 2/1978 Taylor ..... A63B 53/007 473/246
4,881,737 A * 11/1989 Mullins ..... A63B 53/065 403/84
5,320,346 A * 6/1994 Phillips ..... A63B 53/02 473/246
5,390,918 A * 2/1995 Meyers ..... A63B 53/065 473/246
5,511,779 A * 4/1996 Meyers ..... A63B 53/065 473/246
5,603,666 A * 2/1997 Bowe ..... A63B 53/02 473/307
5,692,969 A * 12/1997 Schooler ..... A63B 53/02 473/248
5,997,409 A * 12/1999 Mattson ..... A63B 53/02 473/244
7,367,896 B2 * 5/2008 Jackson ..... A63B 53/007 473/246
7,963,855 B2 * 6/2011 Sander ..... A63B 53/02 473/288
8,088,019 B1 * 1/2012 Long ..... A63B 53/02 473/245
8,105,178 B2 * 1/2012 Sander ..... A63B 53/02 473/288
8,419,563 B2 * 4/2013 Sander ..... A63B 53/02 473/244
8,500,571 B2 * 8/2013 Sander ..... A63B 53/02 473/288
8,523,701 B2 * 9/2013 Knutson ..... A63B 53/02 473/246
8,616,996 B2 * 12/2013 Murphy ..... A63B 53/02 473/246
8,715,102 B1 * 5/2014 Aguinaldo ..... A63B 53/02 473/246
8,876,626 B2 * 11/2014 Suwa ..... A63B 53/02 473/246
9,283,446 B2 * 3/2016 Motokawa ..... A63B 53/02
2012/0071258 A1 * 3/2012 Yamaguchi ..... A63B 53/00 473/287
2013/0123038 A1 * 5/2013 Cole ..... A63B 53/02 473/307
2013/0288816 A1 * 10/2013 Nakamura ..... A63B 53/02 473/309
2015/0111658 A1 * 4/2015 Yamaguchi ..... A63B 53/00 473/306

* cited by examiner $N = T\cos(\theta) - F_M \sin(\theta)$ $F_M' = F_M \cos(\theta)$ $f_f = \mu_{steel/T_i} N$ For Movement $F_M' > f_f$ $N = T$ $F_M = M/R$ $f_f = \mu_{steel/T_i} N$ For Movement $M/R > \mu_{steel/f_f} N$

ADJUSTABLE GOLF CLUB SHAFT AND HOSEL ASSEMBLY

CROSS REFERENCES TO RELATED APPLICATIONS

The present application is a division of U.S. patent application Ser. No. 14/223,594, filed on Mar. 24, 2014, which is a division of U.S. patent application Ser. No. 13/326,156, filed on Dec. 14, 2011, and issued on May 6, 2014, as U.S. Pat. No. 8,715,102, which is a continuation in part of U.S. patent application Ser. No. 13/311,319, filed on Dec. 5, 2011, and issued on Apr. 1, 2014, as U.S. Pat. No. 8,684,859, which claims priority to U.S. Provisional Application No. 61/451,523, filed on Mar. 3, 2011, and to U.S. Provisional Application No. 61/452,521, filed on Mar. 14, 2011, to each of which the present application also claims priority, and the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having an adjustable shaft and hosel assembly. More specifically, the present invention relates to a golf club shaft and hosel connection assembly that allows a user to adjust the loft, lie, and face angle of the golf club head, either dependently or independently without requiring the user to remove the shaft from the hosel completely.

DESCRIPTION OF THE RELATED ART

It is known that changing the angle of a golf club shaft with respect to the golf club head will change certain club specifications, including loft angle, lie angle, and face angle. Several types of adjustable golf clubs are currently available on the market. These models allow the user to adjust loft, lie and face angle by adjusting certain golf club components, which themselves rotate the shaft in a cone-shaped path about a reference axis.

Current adjustable golf club models include rotatable component features that are used for angle indexing and for transmitting torque forces between the club body and shaft, and vice-versa. These component features limit the number of shaft angle adjustments, however. The maximum angular range of these designs has been found to be approximately ±2.0° from the reference axis. None of the currently available adjustable golf clubs permit a 0° angle adjustment with respect to the reference axis.

The adjustable golf club models currently on the market have other drawbacks in addition to limited shaft angle adjustability. Because the shaft is fixed to the standard rotating features of these golf clubs, which operate on a fixed cone range of movement, the shaft graphics and grip reminder rotate out of orientation with the club head body when angles are adjusted. This can frustrate golfers who rely on grip reminders or asymmetric grips while using their clubs.

Furthermore, in many cases a user has to remove certain shaft components to make angle adjustments, thus increasing the difficulty of making adjustments as well as increasing the likelihood that the user will lose important pieces of the adjustable golf club head. For example, with current designs, shaft interchangeability is achieved by removing mechanical fastener(s) that attach the shaft component to the club head body. A different shafted component can then be added and the mechanical fastener(s) can be re-used to attach the shaft component to the club head body. Golfers run the risk of losing the mechanical fastener(s) when they make desired adjustments.

BRIEF SUMMARY OF THE INVENTION

The present invention relates to wood golf club heads that have angular adjustable shaft and hosel assemblies.

One aspect of the present invention is an adjustable golf club head comprising a face, a sole, a crown, a shaft sleeve having a shaft sleeve axis and a shaft-receiving bore, the shaft-receiving bore having a bore axis that is coaxial with the shaft sleeve axis, a hosel having a hosel bore extending from the sole to the crown, at least part of the hosel bore having a diameter sized to receive at least a part of the shaft sleeve, and a first tubular adjustment piece having non-parallel upper and lower surfaces, wherein the first tubular adjustment piece fits around a section of the shaft sleeve when at least a part of the shaft sleeve is inserted within the hosel bore, wherein rotating the first tubular adjustment piece around the shaft sleeve changes the angle of the shaft sleeve with respect to the face, wherein the first tubular adjustment piece provides a plurality of angular adjustments, and wherein the shaft sleeve does not rotate around the bore axis more than 5 degrees for any of the plurality of angular adjustments. This adjustable golf club head may further comprise a flange within the hosel bore, wherein the flange comprises a convex lower surface and a fastener comprising a fastener head and a threaded body, wherein the fastener is inserted into the hosel bore through the sole, wherein the threaded body engages the shaft sleeve to connect the shaft sleeve to the head, and wherein the fastener head abuts the convex lower surface of the flange when the threaded body is fully engaged with the shaft sleeve.

In a further embodiment, the adjustable golf club head comprises a washer disposed between the fastener head and the convex lower surface of the flange, wherein the washer comprises a concave surface that mates with the convex lower surface of the flange. In an alternative embodiment, the fastener head comprises a concave surface that mates with the convex lower surface of the flange. In a further embodiment, a radius of the convex lower surface is equivalent to a distance between a rotation point of the shaft sleeve and a point at which the fastener head makes contact with the flange. In another embodiment, a radius of the convex lower surface is 0.1 to 3.0 inches. In yet another embodiment, the shaft sleeve further comprises a universal joint connection having a joint bore sized to securely receive the threaded body of the fastener, and the universal joint connection may protrude from a lower portion of the shaft sleeve and comprise at least two planar sides and at least two curved sides. In a further embodiment, the golf club head may comprise a fitting member sized to fit within the hosel bore proximate the crown, the fitting member comprising a fitting member bore sized to receive the universal joint connection. The fitting member may be able move within the hosel bore along a first axis, and the universal joint connection may be able move within the fitting member bore along a second axis. In a further embodiment, the first axis is perpendicular to the second axis. The shaft sleeve of these embodiments may have a 360 degree range of angular movement around a rotation point when the fitting member and the universal joint connection are fully assembled with the hosel In another embodiment, the adjustable golf club head may further comprise a second tubular adjustment piece having non-parallel upper and lower surfaces, wherein the second tubular adjustment piece is disposed proximate the first tubular adjustment piece. In this embodiment, the first and second tubular adjustment pieces may each comprise one or more markings on an external surface, and wherein the one or more markings indicate angular adjustments provided by said adjustment pieces. The adjustable golf club head may be any type of club head, such as a wood-type golf club head, or more specifically a driver golf club head.

Another aspect of the present invention is an adjustable driver head comprising a face, a sole, a crown, a shaft sleeve comprising a shaft sleeve axis, a shaft-receiving bore having a bore axis that is coaxial with the shaft sleeve axis, and a universal joint connection protruding from a lower portion of the shaft sleeve, wherein the universal joint connection comprises at least two flat sides and at least two curved sides, and wherein the universal joint connection further comprises a threaded joint bore, a fitting member comprising a fitting member bore and an external surface, wherein each of the fitting member bore and the external surface have at least two flat sides and at least two curved sides, and wherein the fitting member bore is sized to receive the universal joint connection, a hosel comprising a hosel bore extending from the sole to the crown, wherein a region of the hosel bore proximate the crown comprises at least two flat sides and at least two curved sides and wherein the region of the hosel bore proximate the crown is sized to receive the fitting member, first and second tubular adjustment pieces, each comprising non-parallel upper and lower surfaces, wherein the first tubular adjustment piece fits around the shaft sleeve when the universal joint connection is assembled with the fitting member and the hosel bore, and a fastener comprising a head and a threaded body, wherein the threaded body engages the threaded joint bore, wherein rotating the first and second tubular adjustment piece around the shaft sleeve changes the angle of the shaft sleeve with respect to the face, and wherein the shaft sleeve does not rotate around the bore axis more than 5 degrees.

In a further embodiment, the driver head may further comprise a flange disposed within the hosel bore, wherein the fastener head abuts the convex lower surface of the flange when the threaded body is fully engaged with the threaded joint bore, and wherein the flange comprises a convex lower surface having a radius that is equivalent to a distance between a rotation point of the shaft sleeve and a point at which the fastener head makes contact with the flange. The radius of the lower convex surface may be between 0.1 and 3 inches.

Yet another aspect of the present invention is an adjustable driver head comprising a face, a sole, a crown, a shaft sleeve comprising a shaft sleeve axis and a shaft-receiving bore, the shaft-receiving bore having a bore axis that is coaxial with the shaft sleeve axis, a hosel having a hosel bore extending from the sole to the crown, the hosel bore sized to receive at least a part of the shaft sleeve, a first tubular adjustment piece disposed around the shaft sleeve and providing a plurality of angular adjustments for the shaft sleeve, a flange within the hosel bore, wherein the flange comprises a convex lower surface, and a fastener comprising a fastener head and a threaded body, wherein the fastener is inserted into the hosel bore through the sole, wherein the threaded body engages the shaft sleeve to connect the shaft sleeve to the head, wherein the fastener head abuts the convex lower surface of the flange when the threaded body is fully engaged with the shaft sleeve, and wherein the shaft sleeve does not rotate around the bore axis more than 5 degrees for any of the plurality of angular adjustments.

Another aspect of the present invention is an adjustable golf club head comprising a body comprising a face, a sole, a crown, and a hosel, a shaft sleeve comprising a shaft sleeve axis and a shaft-receiving bore having a bore axis that is coaxial with the shaft sleeve axis, a ball joint comprising a threaded joint bore, a socket sized to receive the ball joint, and a fastener comprising a head and a threaded body, wherein the threaded body engages the threaded joint bore, wherein moving the shaft sleeve changes the angle of the shaft sleeve with respect to the body, and wherein the shaft sleeve does not rotate around the bore axis more than 5 degrees. The ball joint and socket may be faceted, and the hosel may be integrally formed with the club head, which may be a driver head.

In a further embodiment, the golf club head may comprise a shaft having graphics and a grip reminder, wherein the shaft is at least partially disposed within the shaft sleeve, and wherein the graphics and the grip reminder do not rotate more than 5 degrees around the bore axis when a user makes angular adjustments. An angle of the shaft sleeve with respect to the body may be adjusted using an angle adjustment tool. Alternatively, the golf club can further comprise a first tubular adjustment piece having non-parallel upper and lower surfaces, wherein the first tubular adjustment piece fits around a section of the shaft sleeve and abuts the hosel, wherein rotating the first tubular adjustment piece around the shaft sleeve changes the angle of the shaft sleeve axis with respect to the body when the shaft sleeve is engaged with the hosel, and wherein the first tubular adjustment piece provides a plurality of angular adjustments. The first tubular adjustment piece may comprise a plurality of angle indicators on its exterior surface.

In another embodiment, the golf club head may further comprise a first wheel having a first bore with a first diameter, and a second wheel having a second bore with a second diameter that is smaller than the first diameter, wherein the threaded body of the fastener fits within the first and second bores, wherein the fastener affixes the first and second wheels to the body, and wherein an angle between the shaft sleeve axis and the body can be adjusted by rotating the first and second wheels. The first and second wheels may each have angle indicators on their exterior surfaces, and the first bore may provide a pivot surface and the second wheel may cause the threaded body of the fastener to move along the pivot surface when the second wheel is turned.

In yet another embodiment, the ball joint may extend from a tip end of the shaft sleeve and the socket may be disposed on the hosel. In an alternative embodiment, the golf club head may further comprise a connection piece having a shaft sleeve receiving bore, wherein the ball joint extends from the hosel, and wherein the socket is disposed on the connection piece opposite the shaft sleeve receiving bore.

Yet another aspect of the present invention is an adjustable golf club head, which may be a driver head, comprising a body comprising a face, a sole, and a crown, a shaft sleeve comprising a shaft sleeve axis, a shaft-receiving bore having a bore axis that is coaxial with the shaft sleeve axis, and a ball joint having a joint bore, the ball joint extending from a tip end of the shaft sleeve, a hosel integrally formed with the golf club body, the hosel comprising a hosel bore extending from an opening in the sole to the crown and a socket sized to receive the ball joint, a fastener comprising a head and a threaded body sized to engage the threaded joint bore, a flange disposed within the hosel bore, wherein the fastener head rests against the flange when the threaded body is engaged with the threaded joint bore, and a first tubular adjustment piece comprising non-parallel upper and lower surfaces and an exterior surface having a plurality of angle markings, wherein the first tubular adjustment piece fits around a section of the shaft sleeve, wherein the lower surface abuts the hosel, wherein rotating the first tubular adjustment piece around the shaft sleeve changes the angle of the shaft sleeve with respect to the body when the shaft sleeve is engaged with the hosel, and wherein the first tubular adjustment piece provides a plurality of angular adjustments. In a further embodiment, the flange may comprise a convex lower surface, wherein the fastener head comprises a concave surface that mates with the convex lower surface, and wherein the fastener head abuts the convex lower surface of the flange when the threaded body is fully engaged with the shaft sleeve.

Yet another aspect of the present invention is an adjustable golf club head comprising a body comprising a face, a sole, and a crown, a hosel integrally formed with the body, the hosel comprising a ball joint having a threaded joint bore, a shaft sleeve comprising a shaft sleeve axis and a shaft-receiving bore having a bore axis that is coaxial with the shaft sleeve axis, and a connection piece having a first opening sized to receive the ball joint, a second opening sized to receive the shaft sleeve, and a threaded surface, a first fastener comprising a head and a threaded body sized to engage the threaded joint bore and removably fix the connection piece to the hosel, and a second fastener sized to encircle the shaft sleeve, the second fastener having threads sized to engage the threaded surface of the connection piece and removably fix the shaft sleeve to the connection piece, wherein moving the connection piece changes the angle of the shaft sleeve with respect to the body. In a further embodiment, the golf club head may comprise a flange disposed within the first opening of the connection piece, wherein the flange has a convex surface, and wherein the first fastener head rests against the flange when the threaded body is engaged with the threaded joint bore.

In another embodiment, the golf club head may comprise a first wheel having a first bore with a first diameter, and a second wheel having a second bore with a second diameter that is smaller than the first diameter, wherein the first and second wheels are disposed within the connection piece, wherein the threaded body of the first fastener is threaded through the first and second bores, wherein the first fastener connects the connection piece to the ball joint, and wherein an angle between the connection piece and the body can be adjusted by rotating the first and second wheels. Alternatively, the golf club head may comprise a first tubular adjustment piece having non-parallel upper and lower surfaces, wherein the first tubular adjustment piece fits around a section of the connection piece and abuts the hosel, wherein rotating the first tubular adjustment piece around the connection piece changes the angle of the connection piece with respect to the body when the shaft sleeve is engaged with the hosel, and wherein the first tubular adjustment piece provides a plurality of angular adjustments.

A further embodiment of this aspect of the present invention may comprise a shaft having graphics and a grip reminder, wherein the shaft is at least partially disposed within the shaft sleeve, and wherein the graphics and the grip reminder do not rotate out of orientation with the golf club head when a user makes angular adjustments. The loft, lie, and face angles of the golf club head may each have an angular adjustment range of 0° to ≥2° from a reference axis.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
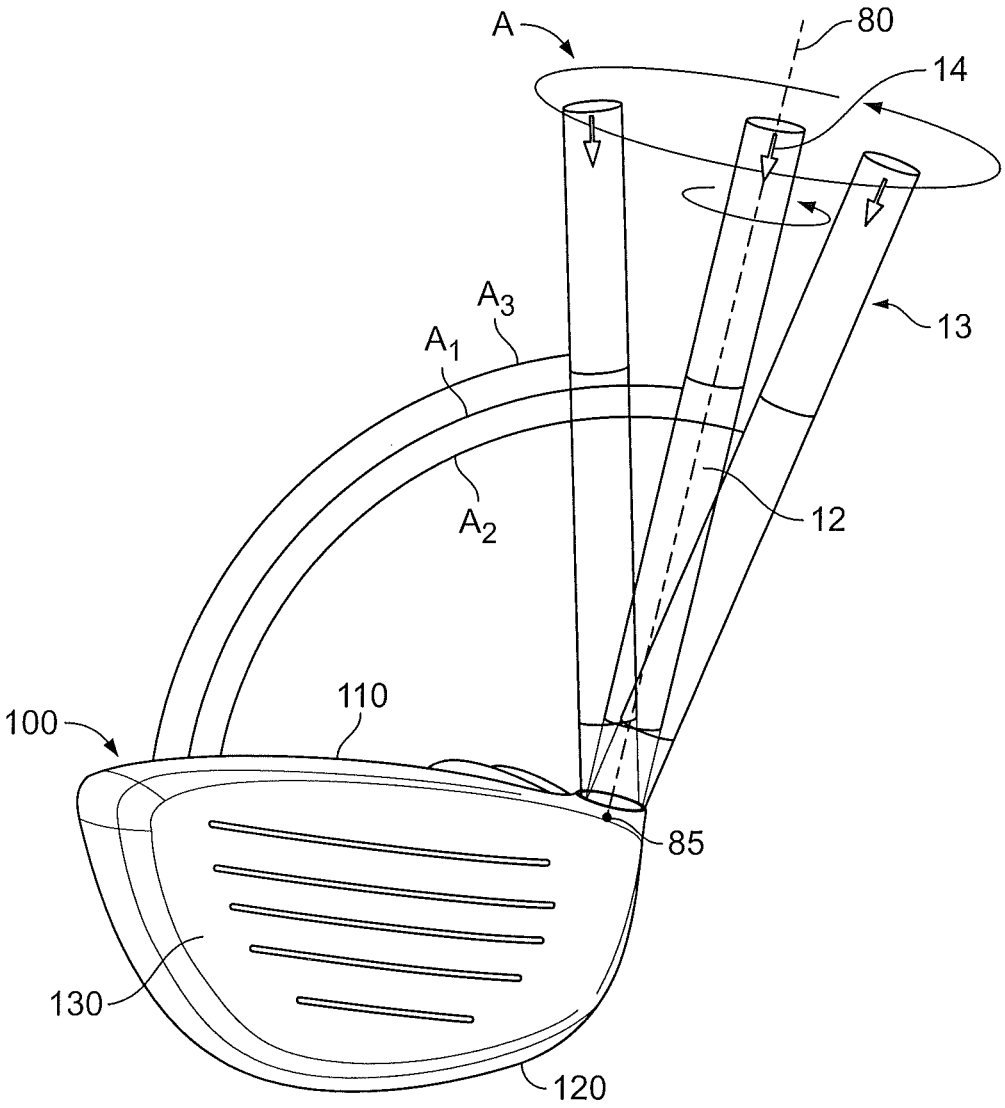
FIG. 1 is a side, perspective view of a golf club head having the adjustability features included in each embodiment of the present invention.
Figure 2:
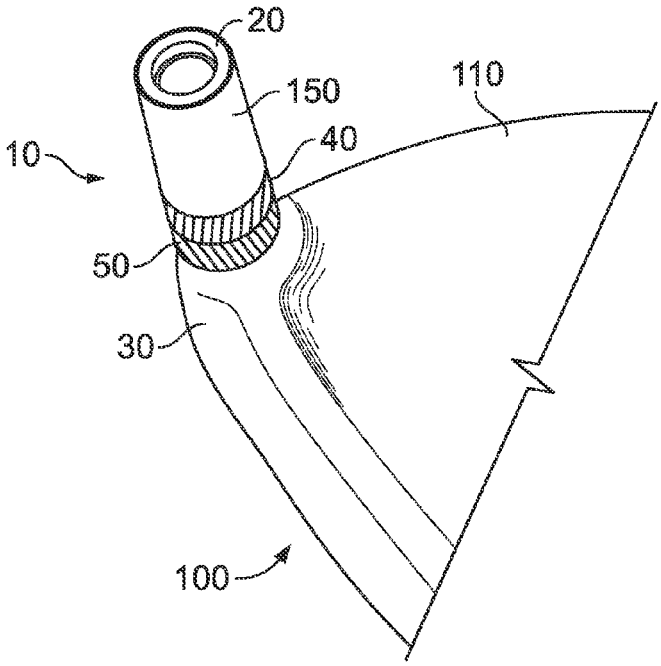
FIG. 2 is top perspective view of a first embodiment of the invention.

Angular adjustability in a golf club head is achieved through universal movement of the golf club shaft with respect to the golf club head, which almost always requires the shaft to rotate around a reference axis. As shown in FIG. 1, unlike other adjustable golf club designs currently available on the market, the present invention allows for universal angular adjustment without requiring the shaft 12, and thus the grip 13, to rotate about a reference axis 80 more than 5 degrees, if at all. As shown, for example, in FIG. 8B, the shaft 12 is disposed within a shaft sleeve 20 having a bore axis that is coaxial with the overall shaft sleeve 20 axis, such that a shaft 12 dispose within the shaft sleeve 20 is coaxial with, and not angled with respect to, the shaft sleeve 20. During adjustment of the golf club of the present invention, rotation of the shaft sleeve 20, and thus the shaft 12, around the reference axis 80 is limited or non-existent for the full range of shaft 12 angle adjustability, represented by "A" in FIG. 1, with respect to the golf club head 100 around a rotation point 85. Preferably the full range of adjustability A allows for at least 0.75 degree of hosel axis tilt in any direction. In the present invention, the torque forces between the golf club head 100 and shaft 12 are coupled and, because there is limited or no rotation about the reference axis 80, the shaft graphic and/or the grip reminder 14 remain oriented with the club head body during angular adjustment, as shown in FIG. 1 with respect to shaft-head angles $A_1$, $A_2$, and $A_3$. The full range of shaft 12 angle adjustability A in the present invention includes the 0° angle with respect to the reference axis 80.

In addition to having non-ideal adjustability features, many of the adjustable golf club heads currently available on the market are difficult to use because they require a user to make minute linear movements with respect to a pivot point to achieve the desired angular change. For example, a 1° change that is made using an adjustability feature located 1 inch from the pivot point requires the user to make a precise, 0.0174 inch linear movement. In contrast with the currently available technology, the present invention includes precise methods for setting and fixing the angular adjustments desired.

The present invention provides golfers with a structure that can be used to easily and quickly modify club specifications such as loft, lie and face angle of their golf club. This invention enables golfers to change these specifications at the practice range or golf course. The tools used to alter the club's specifications are few in number and can be carried in a pocket of the user's golf bag. Furthermore, the technical ability required to modify the club specifications with this invention is minimal and its approach is intuitive and easy to understand.

The present invention is also valuable because a golfer's swing often changes over time, which can require alterations to his clubs. A golfer may improve his game through lessons and may gain greater flexibility and strength through practice and exercise. As such, it is reasonable for a golfer to wish to change his club's face, lie, and/or loft angles to help improve his accuracy, distance, and feel as needed or desired. This applies to all types of golf clubs. In fact, though the Figures show the present invention in connection with a driver-type golf club head, the embodiments of the present invention disclosed herein may be used in connection with other wood-type golf club heads as well as with irons and putters.

Figure 7A:
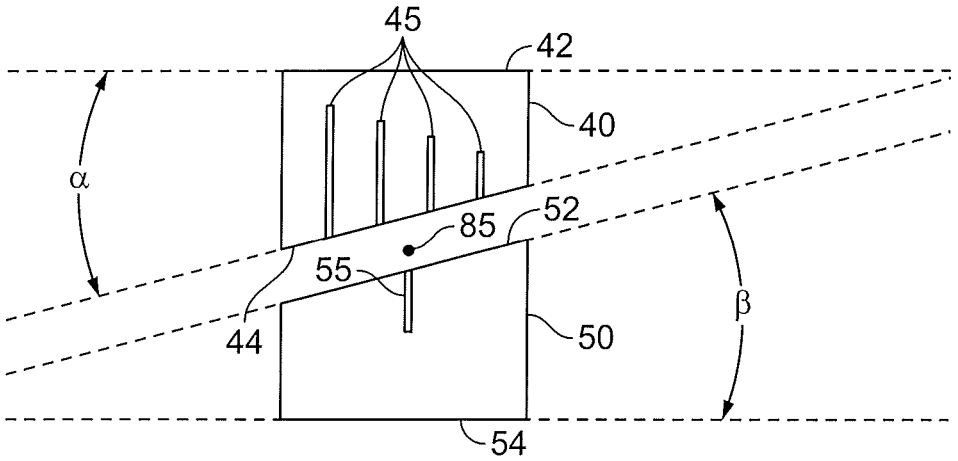
FIG. 7A is a side plan view of upper and lower shim portions of the embodiment shown in FIG. 1.
Figure 7B:
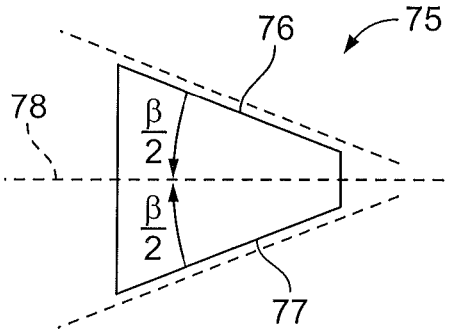
FIG. 7B is a side plan view of a single shim that can be used in another embodiment.
Figure 8A:
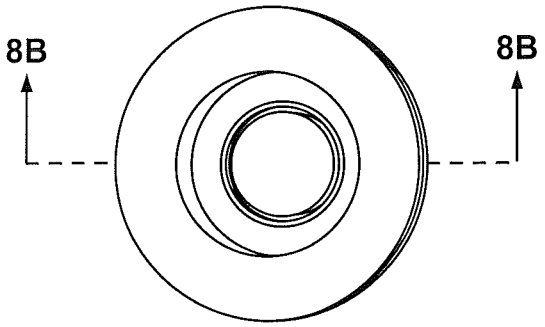
FIG. 8A is a top plan view of the upper and lower shim portions assembled with the shaft sleeve.
Figure 8B:
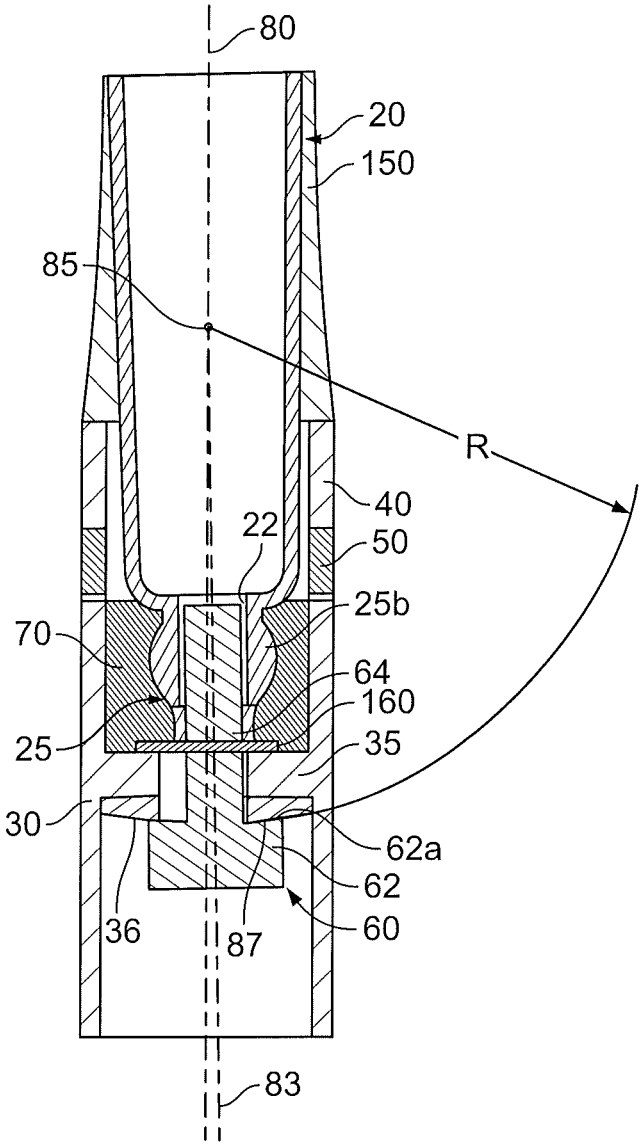
FIG. 8B is a side, cross-sectional view of the embodiment shown in FIG. 8A.

A first embodiment of the present invention is shown in FIGS. 1-8B. This adjustable hosel assembly 10 includes a shaft sleeve 20, a hosel 30, an upper tubular adjustment piece, referred to herein as a shim 40, a lower tubular adjustment piece, also referred to herein as a shim 50, a fastener 60, and a fitting member 70, and is associated with a golf club head 100 having a crown 110, sole 120, and face 130. The assembly 10 also includes a ferrule 150, which can envelope or lie against the shaft (not shown) or the shaft sleeve 20, as shown in FIG. 8B. As shown in FIGS. 3 and 4A-D, the shaft sleeve 20 includes a universal joint connection 25, which preferably is a protrusion that is flat 25*a* on two opposing sides, as shown in FIG. 4A, and curved or spherical 25*b* on the other two opposing sides, as shown in FIGS. 4B-D. As shown in FIGS. 4B-D, the spherical portions 25*b* of the universal joint connection 25 may have different diameters.

Figure 5:
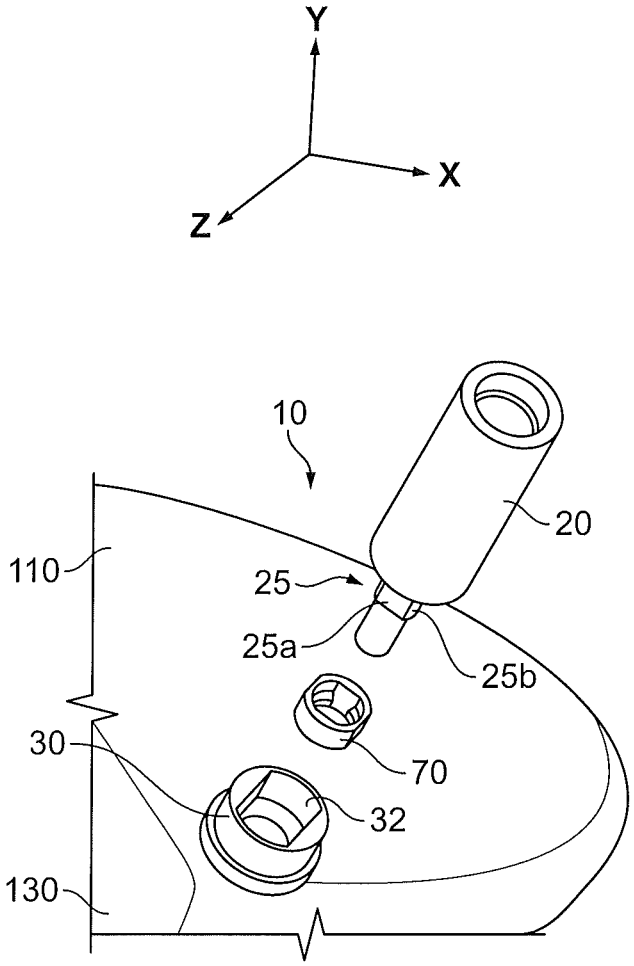
FIG. 5 is an exploded view of shaft sleeve, fitting member, and hosel portions of the embodiment shown in FIG. 1.
Figure 6A:
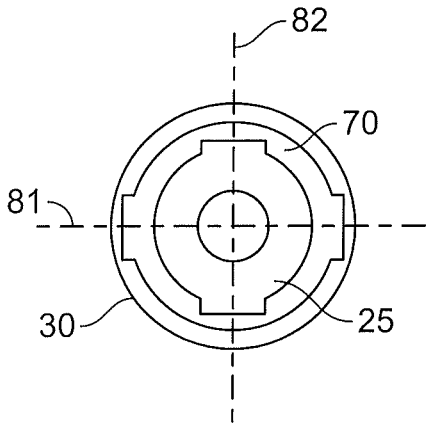
FIGS. 6A and 6B are top, cross-sectional views of fitting members available for use in connection with the embodiment shown in FIG. 1.
Figure 6B:
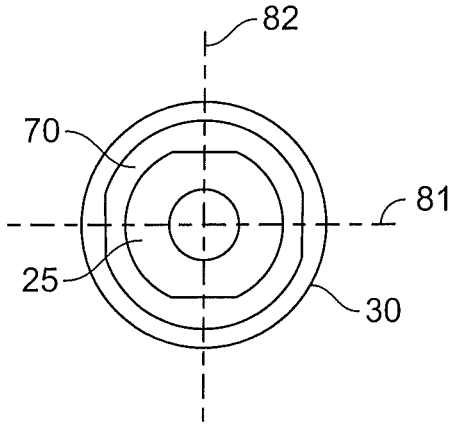

In the first embodiment, the fitting member 70 fits within the hosel 30 of the adjustable hosel assembly 10. As shown in FIG. 5, the mouth 32 of the hosel 30 is shaped to receive the fitting member 70 by having two flat sides and two curved sides. As shown in FIGS. 5, 6A, and 6B (an alternative embodiment to the one shown in FIG. 6A), the universal joint connection 25 fits within the fitting member 70 and can move within the fitting member 70 along a first axis 81. Similarly, the fitting member 70 can move within the hosel mouth 32 along a second axis 82. The two axes 81, 82 are disposed at 90° angles with respect to one another, and provide full, 360° rotation capability for the shaft sleeve 20, and thus the shaft (not shown), with respect to the golf club head 100.

Figure 3:
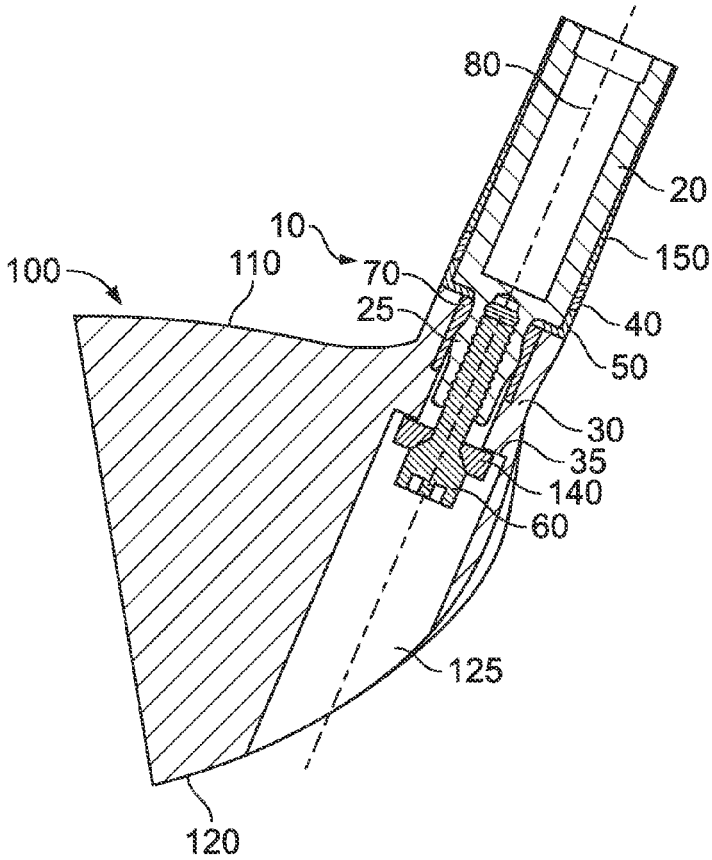
FIG. 3 is a side, cross sectional view of the embodiment shown in FIG. 1.
Figure 4D:
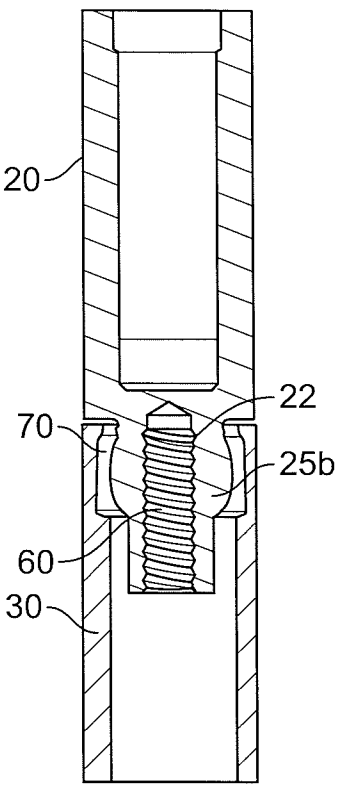
FIGS. 4A through 4D are side, cross sectional views of assembled shaft sleeve, fitting member, and hosel portions of the embodiment shown in FIG. 2.
Figure 4C:
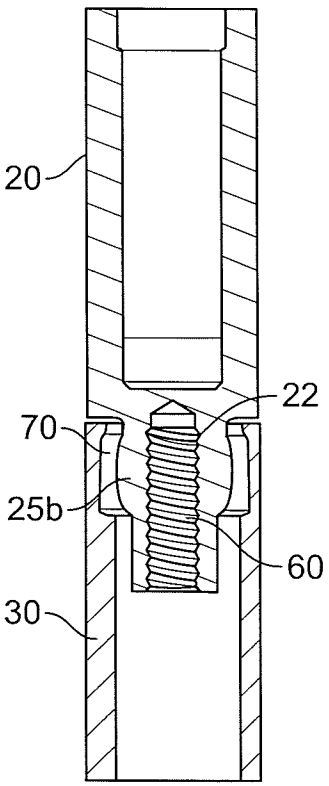
Figure 4B:
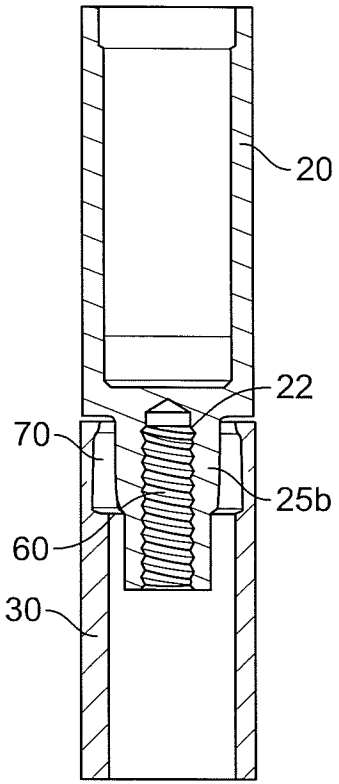
Figure 4A:
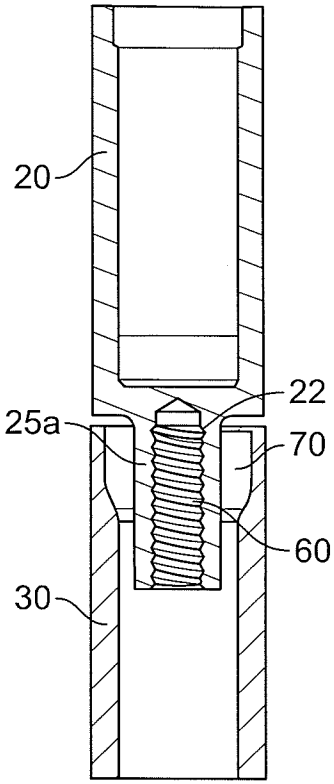

When the universal joint connection 25, fitting member 70, and hosel 30 are fully assembled with upper and lower shims 40, 50 described herein and shown in FIG. 7A, the universal joint connection 25, and hence the shaft sleeve 20, is capable of moving 360° around a rotation point 85 located on the shaft reference axis 80. The greatest force in this assembly is applied within the hosel 30 with respect to the fitting member 70 and universal joint connection 25. In contrast with other adjustable hosel designs currently available on the market, the shims 40, 50, which are located proximate to or around the rotation point 85 to control angular adjustment, as shown in FIGS. 3, 7A, and 8B, do not bear the brunt of the force between the shaft sleeve 20 and the golf club head 100.

As shown in FIG. 7A, the shims 40, 50 each have non-parallel (tapered), mating upper surfaces 42, 52 and lower surfaces 44, 54 and work together by moving the shaft sleeve 20, and thus an installed shaft (not shown), so that it has a desired angle with respect to the hosel 30 and thus the golf club head 100. In other words, the shims 40, 50 allow a user to rotate the shaft sleeve 20, and thus the shaft, from 0° to a desired maximum degree angle with respect to the reference axis 80. The angle $\alpha$ between the upper and lower surfaces 42, 44 of the upper shim 40 may be equivalent to the angle $\beta$ between the upper and lower surfaces 52, 54 of the lower shim 50, or they may differ. The upper surface 42 of the upper shim 40 may be parallel with the lower surface 54 of the lower shim 50, or these surfaces 42, 54 may be non-parallel. In an alternative embodiment, the shims 40, 50 may be combined into a single adjustment piece 75 having non-parallel upper and lower sides 76, 77 as shown in FIG. 7B and angles $\beta/2$ between their upper and lower sides 76, 77 and a midline 78.

In the first embodiment shown in FIG. 7A, the shims 40, 50 include angle markings 45, 55 on their sides to permit a user to select a desired shaft sleeve 20 angle. The shims 40, 50 may also include locating pins and sockets to receive said pins to permit a user to more easily select the desired shaft sleeve angles, as shown in U.S. Pat. No. 2,027,452 to Rusing, the relevant disclosure of which is incorporated by reference in its entirety herein Preferably, the number of angular positions provided by the shims 40, 50 is determined by the formula of A*N positions created between the first contact surface set, such as the lower surface 54 of the lower shim 50 and its contact surface on the hosel 30, and B*N positions created between a second contact surface set of the upper surface 52 of the lower shim 50, and the lower surface 44 of shim 40, and C*N positions created between a third contact surface set of the of the upper surface 42 of shim 40 and its contact surface on the shaft sleeve 20, wherein each of A,B,C, and N can be an integer. The relationships between these formulae can be A=C>B, C≥B≥A=1, A≥B≥C=1, C≥B≥A≥0 or A≥B≥C≥0. This can be repeated for systems of i contact surface sets, where i is an integer and i≥3.

The shims 40, 50, shaft sleeve 20, fitting member 70, and hosel 30 of the golf club head 100 are held together by the fastener 60. The fastener 60, which in the preferred embodiment is a bolt or screw, is inserted through an opening 125 in the sole 120 of the golf club head 100 and engages the universal joint connection 25 of the shaft sleeve 20, which includes a hollow, threaded bore 22 sized to receive the fastener 60. In an alternative embodiment, the fastener 60 comprises one or more snap rings, which may or may not be permanently attached to the hosel assembly 10. In the preferred embodiment, the fastener 60 provides the preload force necessary to hold the other components of the embodiment together during use. The component sizes of these connections, and others described herein, are what limit the maximum angular adjustment. Removal of the shaft is not necessary for angular adjustment in this or in other embodiments described herein—instead, the fastener 60 needs only to be loosened from the shaft sleeve 20 so that the component parts can be rotated with respect to each other.

As shown in FIGS. 3 and 8B, the fastener 60 preferably includes a head 62 and a threaded portion 64. In the preferred embodiment, the head 62 of the fastener 60 abuts a flange 35 located within the hosel 30, against which the fitting member 70 can also rest. The flange 35 provides a brace towards which the fastener 60 pulls the other components of the adjustable hosel assembly 10 when fully assembled. The flange 35 is preferably formed integrally with the hosel 30, but may, in an alternative embodiment, be formed as a separate piece and bonded to the hosel 30. As shown in FIG. 8B, the fastener 60 pulls the shaft sleeve 20 towards the hosel 30, trapping the shims 40, 50 between the ferrule 150 (or another ledge provided by the shaft sleeve 20) and the hosel 30, and pressing the upper shim 40 (or, in an alternative embodiment, the single shim 75) against the ferrule 150 (or the other ledge provided by the shaft sleeve 20), thus causing the shaft sleeve 20 to tilt with respect to the head 100. In this way, an angle between the shaft sleeve 20 and the head 100 that is selected by a user rotating the shims 40, 50 around the shaft sleeve 20 can be semi-permanently fixed for use during a round of golf.

The present invention is functional when the contact surface between the fastener 60 and flange 35 is flat, as shown in FIG. 3. This flat-surface configuration is not ideal, however, because when the shaft sleeve 20 is moved with respect to the reference axis 80, the shaft sleeve 20 changes position within the hosel 30 and moves the fastener 60. When the fastener 60 is tightened, the alignment forces on the hosel 30 from contact between the golf club head 100 the shaft sleeve 20, and the shims 40, 50 create a moment on the shaft sleeve 20 which in turn creates a moment on the fastener 60 around the rotation point 85, and creates a resultant frictional force opposite the fastener's 60 motion. The greater the angle between the reference axis 80 and the resulting axis 83 of the shaft sleeve, i.e., the greater the angular options offered by the shims 40, 50 in the preferred embodiment, the more frictional force is created. When this happens, the fastener 60 may not securely hold the shaft sleeve 20 in the desired position with respect to the reference axis 80, and there can be unwanted slippage that can affect the angle of the shaft sleeve 20 with respect to the golf club head 100.

This problem can be overcome by incorporating into the hosel 30 a flange 35 that has a convex lower surface 36, as shown in FIG. 8B. The radius of the convex surface is preferably between 0.1 to 3.0 inches, and most preferably matches the distance R between the pivot or rotation point 85 of the shaft sleeve 20 and the point 87 at which the fastener head 62 contacts the flange 35. The convex lower surface 36 may be integrally formed with the flange 35, or it may be a separate piece that is bonded to a lower surface of the flange 35 after the flange 35 and hosel 30 are formed. The head 62 of the fastener 60, or a washer 140 disposed between the fastener head 62 and the flange 35, preferably has a concave surface 62*a* that mates with the convex lower surface 36 of the flange, and permits the head 62 to slide along the convex lower surface 36 as a user adjusts the angular relationship between the shaft and the golf club head 100. In an alternative embodiment, the flange 35 may have a concave surface and the fastener head 62 or washer 140 may have a mating convex surface.

Figure 9A:
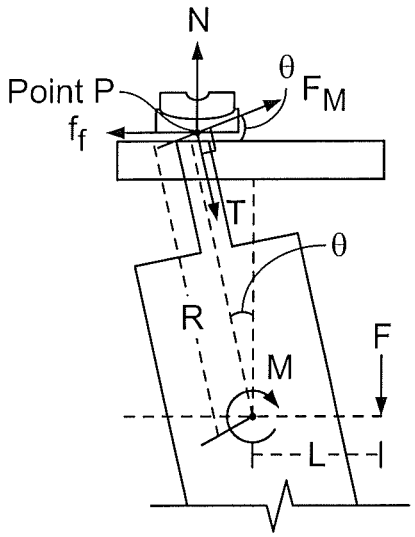
FIG. 9A is a diagram showing the forces involved in one configuration between a flange and a fastener assembly
Figure 9A:
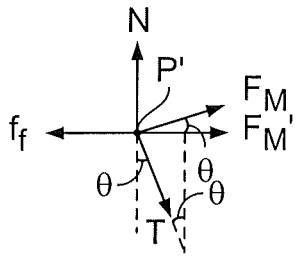
Figure 9B:
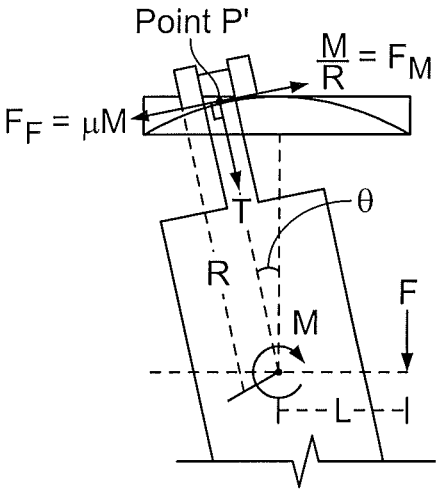
FIG. 9B is a diagram showing the forces involved in another configuration between a flange and a fastener assembly.
Figure 9B:
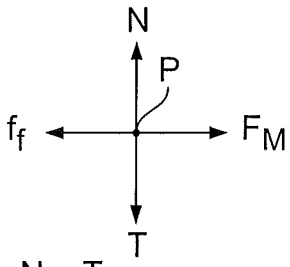

FIGS. 9A and 9B illustrate the forces present in the flat-surface and curved-surface configurations described herein. With reference to each of these Figures, F is the alignment force that results from assembling the adjustable hosel assembly 10, M is the resultant moment about the rotation point 85, derived from the equation F-2FL, R is the distance from the rotation point 85 to the contact point 87 between the fastener head 62 and the flange 35, L is the distance from the rotation point 85 to the adjustment surface's contact force, μ is the coefficient of friction, T is the mating force between the fastener 60 and the shaft sleeve 20, $F_m$ is the relocation moment force due to the adjustment, also represented as M/R, and $F_f$ is the frictional force between the fastener and the fixed head surface.

As shown in FIG. 9A, the reaction forces at P created by the flat-surface configuration are not aligned with the fastener surface, as compared to the reaction forces at P' created by the curved-surface configuration, shown in FIG. 9B, which are tangent and normal to the surfaces. In fact, the alignment forces in FIG. 9B are greater than the frictional forces created by the adjustable hosel assembly 10, which is beneficial because the alignment forces must be greater than the frictional forces for moment to accord during the fastening process. If there is a misalignment of the alignment surfaces between the flange 35 and the head 62 of the fastener 60, the curved surface configuration described herein has a $F_M$ with a larger value than $F_M \cos(\theta)$, associated with the flat-surface configuration, if both are clamped by the same T mating force and the alignment moment is the some.

In order to prevent loss of the fastener 60 after it is loosened to adjust the angle of the shaft sleeve 20, the fastener 60 may be retained within the hosel 30 of the golf club head 100 by any number of mechanisms or features, including those disclosed in U.S. Pat. No. 8,002,644, the disclosure of which is hereby incorporated in its entirety herein. In the preferred embodiment, the fastener 60 is retained within the hosel 30 by means of an o-ring 160 attached to the threaded portion 64 of the fastener 60 after it is inserted into the hosel 30, such that the flange 35 is sandwiched between the head 62 of the fastener 60 or a washer 140 and the o-ring as shown in FIG. 7B.

Figure 10:
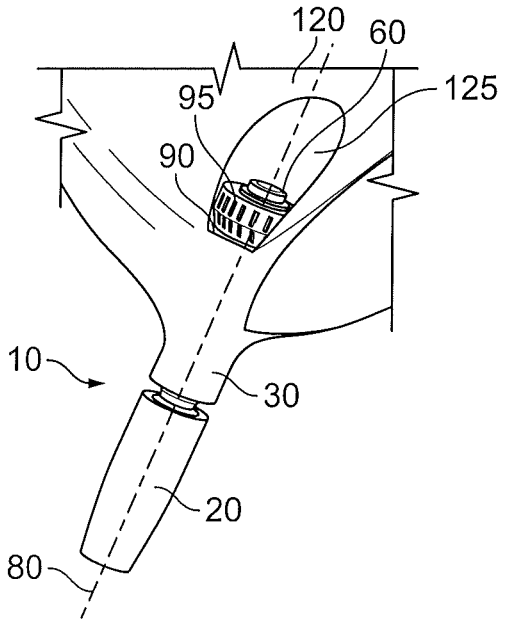
FIG. 10 is a bottom perspective view of a golf club head having a second embodiment of the present invention.
Figure 11:
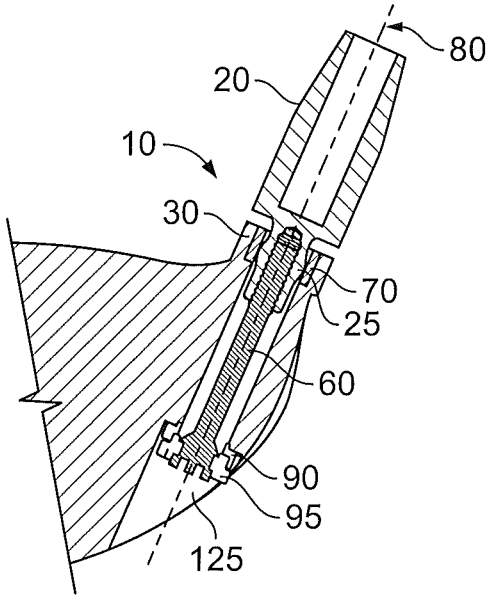
FIG. 11 is a cross-sectional view of the embodiment shown in FIG. 10.

A second embodiment of the present invention is disclosed in FIGS. 10 and 11. This embodiment has the same components shown in FIG. 5, including the shaft sleeve 20 with a universal joint connection 25 that preferably is flat on two sides and spherical on two sides, a fitting member 70, a hosel 30 with a hosel mouth 32 to receive the fitting member, and a fastener 60. Instead of shims 40, 50, however, the shaft angle of the second embodiment is adjusted using a pair of eccentric wheels 90, 95 that are disposed within and accessible via an opening 125 in the sole 120 of the golf club head.

Figure 12:
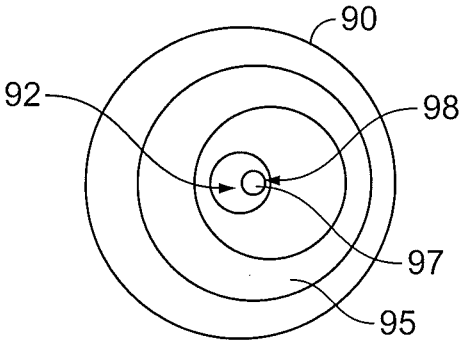
FIG. 12 is a plan view of the wheels of the embodiment shown in FIG. 10.

The wheels 90, 95 each have bores 92, 97 through their centers to receive the fastener 60 and are connected to the shaft and hosel assembly 10 via the fastener 60, as shown in FIGS. 10 and 11. The fastener head 62, or a washer 140 with which it interacts, may also have the same concave structure discussed herein, and the outermost wheel 95 may have a mating convex structure to minimize unwanted friction or slippage during operation of the assembly 10. As shown in FIG. 12, the first wheel 90 bore 92 has a diameter that is larger than of the second wheel 95 bore 97 and creates a pivot surface 98. The second wheel 95 bore 97 is sized so that it snugly receives the fastener 60 and guides the fastener 60 around the pivot surface 98 as the second 95 wheel is turned. The first wheel bore 92 may have dimensions of 1° by 1 inch by R0.0175 inch. The wheels 90, 95 are preferably marked with angle indicia.

The first wheel 90, which is closest to the golf club head, sweeps the shaft sleeve 20 the desired angle 360° around the reference axis 80. The second wheel 95 rotates the shaft sleeve 20 from 0° to the maximum degree with respect to the reference axis. Combinations of these rotations modify the loft, lie, and face angles by rotating the universal joint connection 25, and thus the shaft sleeve 20 and the shaft (not shown) around the reference axis 80.

Figure 13:
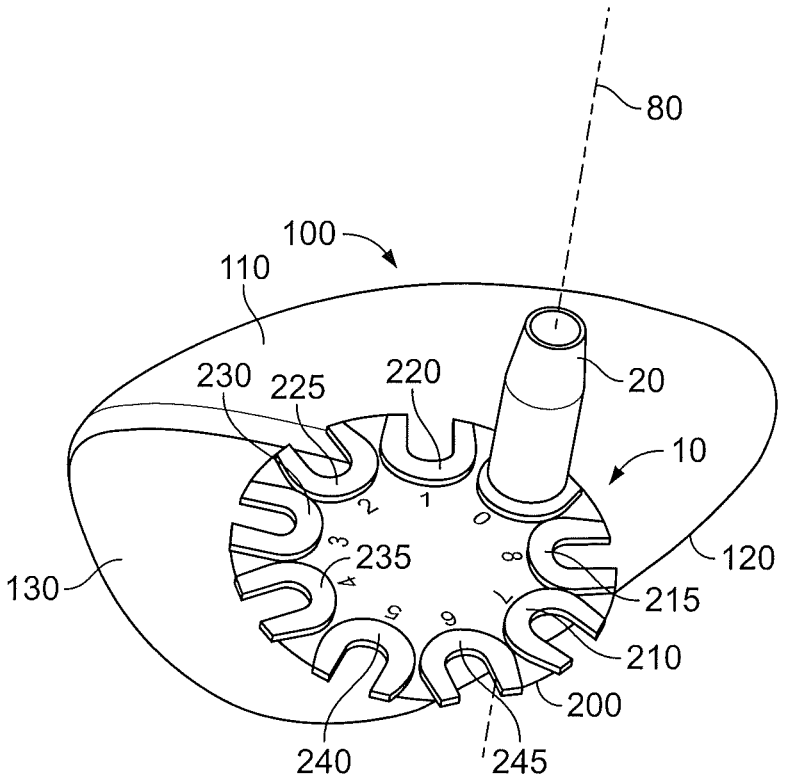
FIG. 13 is a side perspective view of a third embodiment of the present invention interacting with an angle adjustment device

A third embodiment of the present invention is shown in FIG. 13. This embodiment has the same components shown in FIG. 5, including the shaft sleeve 20 with a universal joint connection 25 that preferably has two flat sides and two spherical sides, a fitting member 70, a hosel 30 with a hosel mouth 32 to receive the fitting member, and a fastener 60. This embodiment may also utilize the convex outermost wheel 95 and concave fastener head 62 configuration to reduce unwanted slippage. The angle of the shaft with respect to the golf club head in this embodiment, however, is adjusted using an angle adjustment tool 200, shown in FIGS. 13 and 18.

The angle adjustment tool 200 preferably has tapered gauge thicknesses 210, 215, 220, 225, 230, 235, 240, 245 at multiple locations around its circumference. The angle adjustment tool 200 is used to set a desired gap angle between the shaft sleeve 20 and hosel 30. The combination of the gap angles of the angle adjustment tool 200 and the orientation of the angle adjustment tool 200 about a reference axis 80 modifies the loft, lie, and face angle of the golf club head. In order to make an adjustment, the fastener 60 is loosened so that a gap angle between the shaft sleeve 20 and the hosel 30 can be adjusted. Once the shaft sleeve 20 is adjusted to have the desired angle with respect to the hosel 30, the fastener is tightened so that the golf club head retains the chosen angle. The fastener head 62, or a washer 140 with which it interacts, and a flange 35 may further have the concave-convex structure discussed in detail herein.

Figure 14:
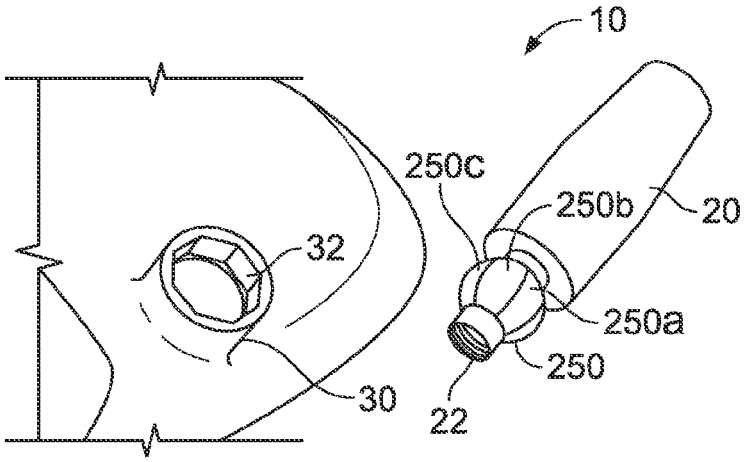
FIG. 14 is an exploded view of shaft sleeve and hosel portions of a fourth embodiment of the present invention.
Figure 15:
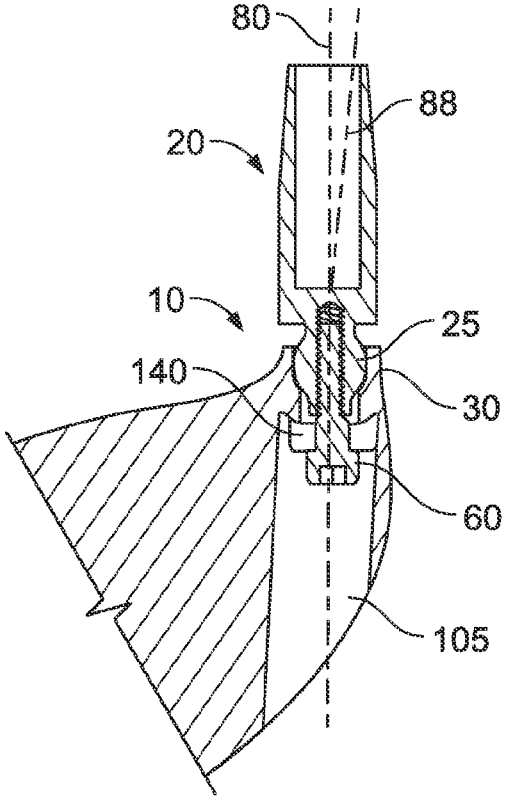
FIG. 15 is an assembled view of the embodiment shown in FIG. 14.

A fourth embodiment of the present invention is shown in FIGS. 14 and 15. This embodiment includes a shaft sleeve 20 having a ball joint 250, which in a preferred embodiment is similar to a ball end Allen wrench at its terminal end, a hosel portion 30 having hosel mouth 32 sized to receive the ball joint 250, and a fastener 60 disposed within and accessible via an opening 125 in the sole 120 of the golf club head. The fastener 60, which in the fourth embodiment is a bolt having a head 62 and a threaded body 64 that is inserted through the sole opening 125 of the golf club head 100, engages the ball joint 250, which includes a hollow, threaded bore 22 to receive the threaded body 64 of the fastener 60. The fastener 60 provides the preload force necessary to hold the other components of the embodiment together during use. The fastener 60 rests against a washer 140, and extends through the hosel portion 30 to engage the bore 22 in the ball joint 250. The ball joint 250 may have multiple facets 250*a*, 250*b*, 250*c* that enable the ball joint 250 to move along multiple axes when disposed in the hosel portion 30, or it may have a smooth surface.

Figure 16:
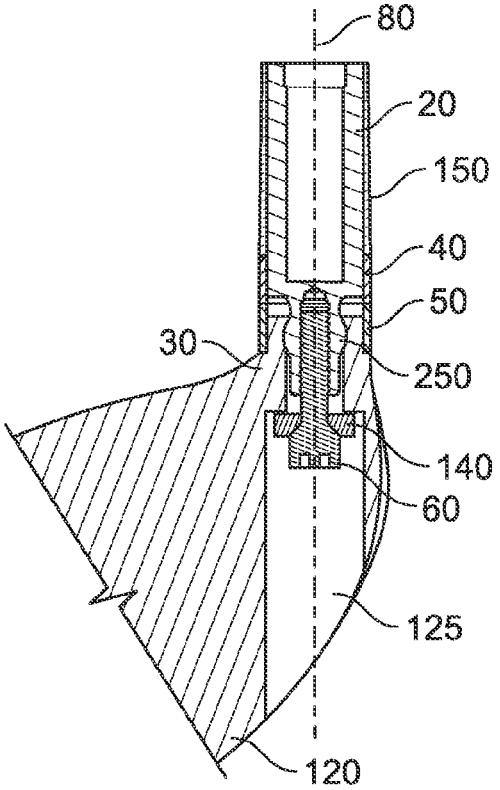
FIG. 16 is a side, cross-sectional view of a fifth embodiment of the present invention.
Figure 17:
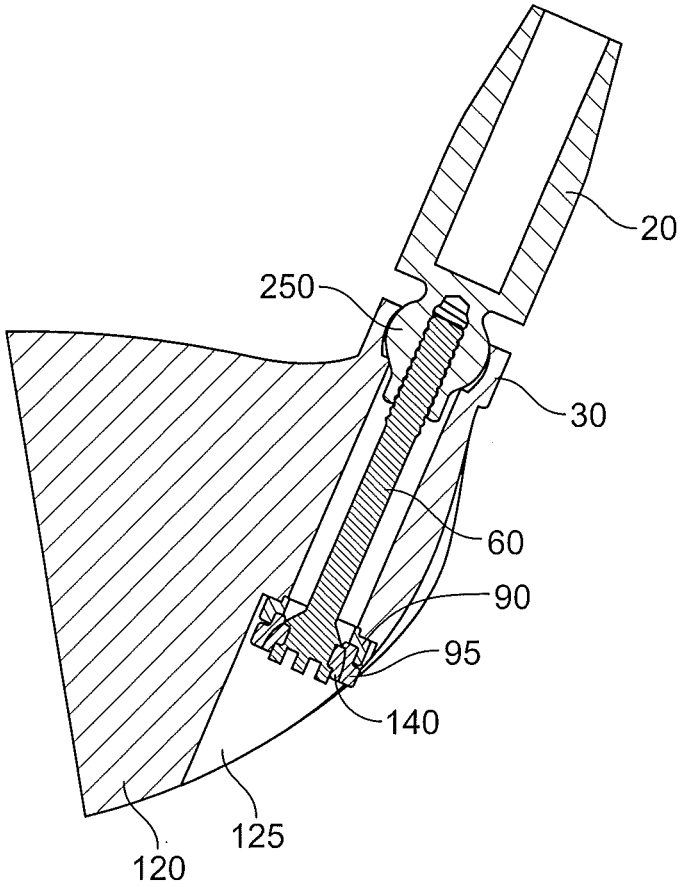
FIG. 17 is a side, cross-sectional view of a sixth embodiment of the present invention.

Though the structure shown in FIGS. 14 and 15 can be adjusted by loosening the fastener 60, moving the ball joint 250 within the socket 32 by hand so that the shaft sleeve 20 has a desired angle with respect to the head 100, and then re-tightening the fastener 60, the present invention provides more precise mechanisms to adjusting these angles. In a fifth embodiment of the present invention, the preferred mechanism for adjusting the loft, lie, and/or face angle of the fourth embodiment is described herein with respect to the first embodiment, is illustrated in FIGS. 2-3, 7A, 7B, and 8B, and is shown in combination with the fourth embodiment in FIG. 16. When the ball joint 250 of the preferred embodiment is resting within the opening 32 of the hosel portion 30 and the upper and lower shims 40, 50 are engaged as shown in FIG. 16, the ball joint 250, and hence the shaft sleeve 20, is capable of moving 360° with respect to a reference axis 80. This angular rotation is controlled using the upper and lower shims 40, 50, as described in detail herein. FIG. 15 shows an example of a shaft sleeve axis 88 that is created when the shaft sleeve is moved out of alignment with the reference axis 80. In this embodiment, the fastener head 62, or a washer 140 with which it interacts, and a flange 35 may further have the concave-convex structure discussed in detail herein.

The embodiment of the invention shown in FIGS. 14 and 15 may also have its shaft sleeve 20 angle adjusted using the pair of eccentric wheels 90, 95 described herein and illustrated in FIGS. 10-12 and 17. In this sixth embodiment of the present invention, shown in FIG. 17, the eccentric wheels 90, 95 are disposed within and accessible via the opening 125 in the sole 120 of the golf club head 100. The lower wheel 95 may be separated from the head 62 of the fastener 60 by a washer 140, or the head 62 of the fastener 60 may directly contact the lower wheel 95 in an alternative embodiment. This embodiment may also make use of the convex wheel 95 surface/concave fastener head 62 or washer 140 structure described herein to minimize unwanted friction or slippage during operation of the assembly 10.

Figure 18:
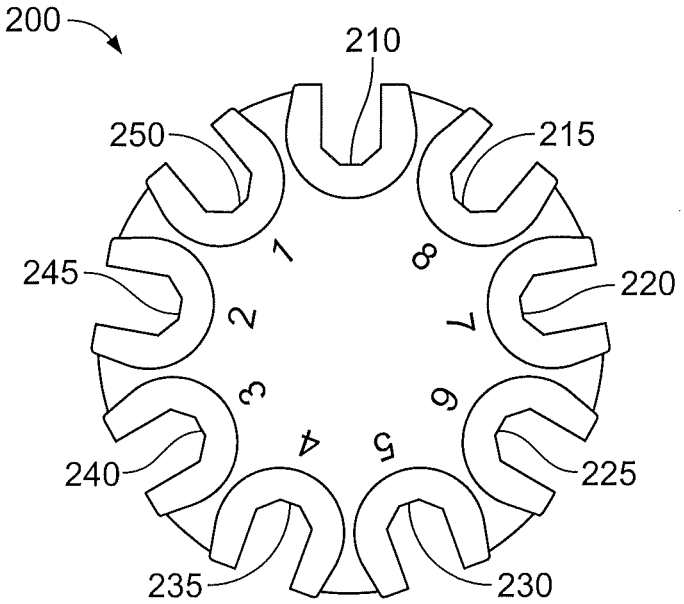
FIG. 18 is a top, plan view of an angle adjustment tool that can be used with the embodiments of the present invention.

In a seventh embodiment, the adjustable shaft and hosel assembly shown in FIGS. 14 and 15 may be adjusted using the angle adjustment tool 200 shown in FIGS. 13 and 18, and described in detail herein. As discussed herein, the fastener head 62, or a washer 140 with which it interacts, and a flange 35 may further have the concave-convex structure discussed in detail herein.

Figure 19A:
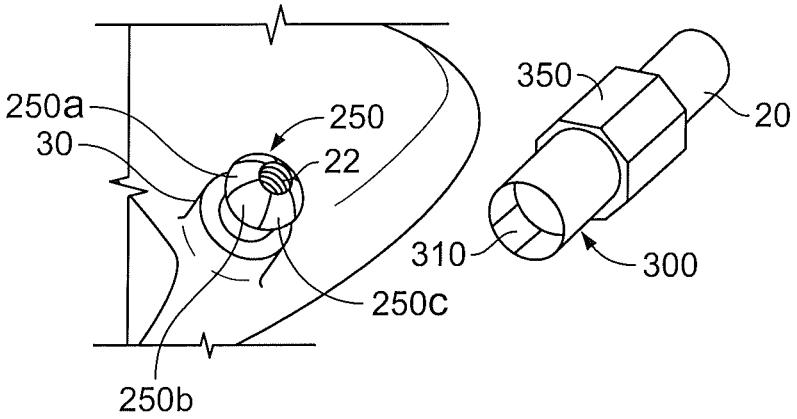
FIG. 19A is an exploded view of hosel, shaft sleeve, upper fastener, and connector piece portions of an eighth embodiment of the present invention.
Figure 19B:
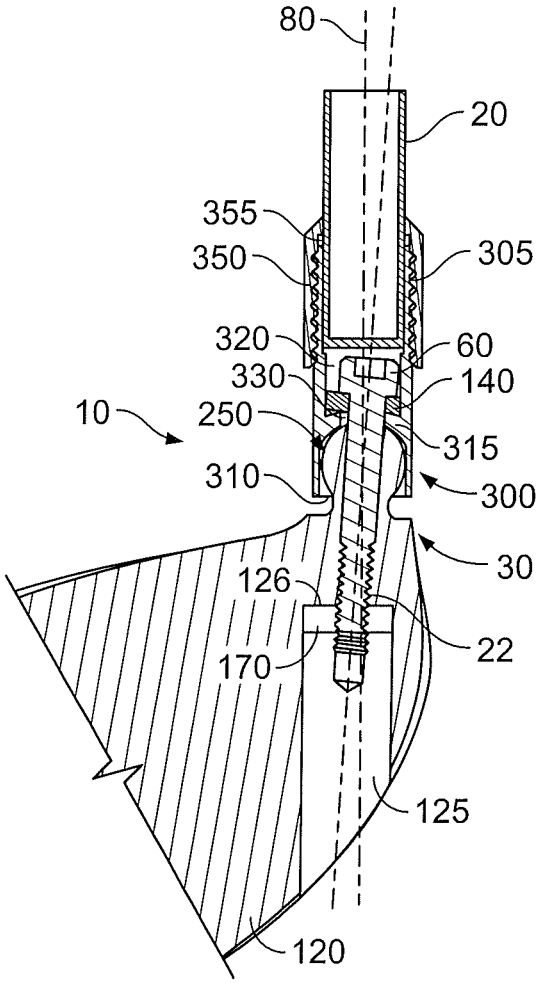
FIG. 19B is an assembled, cross-sectional view of the embodiment shown in FIG. 19A.

An eighth embodiment of the present invention is shown in FIGS. 19A and 19B. In this embodiment, the ball joint 250 is disposed on and projects from an end surface of the hosel 30. The ball joint 250 preferably is integrally formed with the hosel 30, but may be permanently or semi-permanently adhered or attached to the hosel via other means. The ball joint 250 preferably has multiple facets 250*a*, 250*b*, 250*c* and a threaded joint bore 22 through its center that can receive a fastener 60. The eighth embodiment further includes a connection piece 300, the adjustment of which determines the lie, loft, and/or face angle of the golf club head 100. The connection piece 300 has a bottom opening 310 sized to snugly receive the ball joint 250, an upper opening 320, and a through-bore 330.

Once the bottom opening 310 receives the ball joint 250, the connection piece 300 is affixed to the ball joint 250, and thus the hosel portion 30, with the fastener 60, which is preferably a bolt. The fastener 60 is inserted through the upper opening 320 of the connection piece 300, extends through the joint bore 22, and terminates in a sole opening 125, where its terminal end is secured with a nut 170, thus retaining the ball joint 250 within the bottom opening 310 of the connection piece 300. The connection piece 300 includes a flange 315 against which the head 62 of the fastener 60 or a washer 140 rests and towards which the fastener 60 pulls the ball joint 250. The flange 315 and fastener head 62 preferably have the convex-concave surface configuration discussed in detail herein. The nut 170 and an upper surface 126 of the sole opening 125 may also have a convex-concave surface configuration to reduce unwanted forces.

The upper opening 320 of the connection piece 300 is sized to receive a bottom portion of a shaft sleeve 20 or the bottom end of a shaft (not shown). The shaft sleeve 20 is permanently affixed to a shaft (not shown) by adhesive or another connection mechanism, or may be integrally formed with the shaft. The shaft or shaft sleeve 20 is retained within the top opening 320 of the connection piece 300 with an upper fastener 350. The upper fastener 350 has a through bore 355 sized to receive the shaft sleeve 20, and at least part of the interior of the upper fastener 350 is threaded. The upper, exterior portion 305 of the connection piece 300, which encircles the upper opening 320, is also threaded so that, when the shaft or shaft sleeve 20 is placed within the upper opening 320 of the connection piece 300, the threaded interior surface of the upper fastener 350 can engage the threaded exterior portion 305 of the connection piece 300 and securely retain the shaft or the shaft sleeve 20 within the connection piece 300.

In this embodiment, the shaft or shaft sleeve 20 angle with respect to the head 100 can be adjusted in a manner similar to that of the other embodiments disclosed herein. In the embodiment shown in FIGS. 19A and 19B, the shaft sleeve 20 must first be removed from the connection piece 300 so that the fastener 60 can be loosened to allow the connection piece 300 to pivot around the ball joint 250 on the hosel portion 30. Once the connection piece 300 is able to move around on the ball joint 250, the angle of the connection piece 300 with respect to the hosel portion 30 can be adjusted by hand or with the angle adjustment tool 200 shown in FIGS. 13 and 18. When the desired angle is attained, the fastener 60 is tightened, the shaft sleeve 20 is reattached to the connection piece 300 with the upper fastener 350, and the golf club head 100 can be used with its new loft, lie, and/or face angle.

Figure 20:
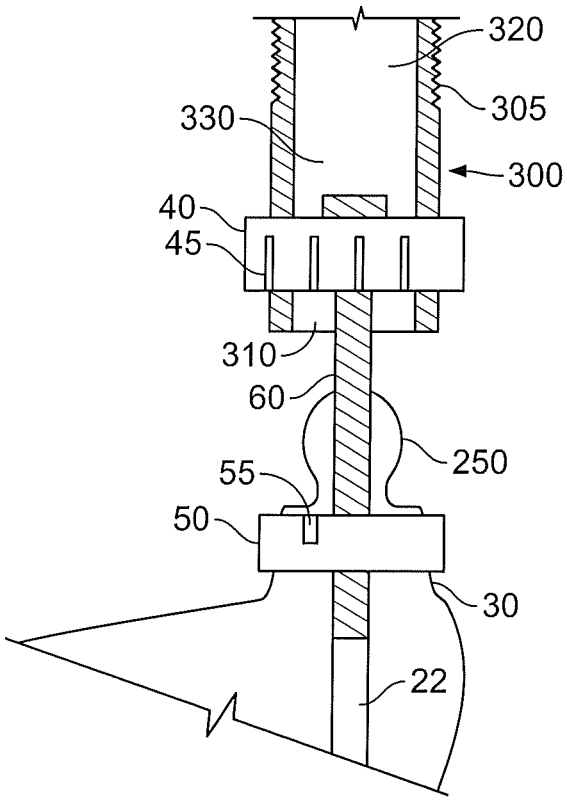
FIG. 20 is an exploded, cross-sectional view of a ninth embodiment of the present invention.

In a ninth embodiment, the assembly shown in FIGS. 19A and 19B is adjusted using the shim 40, 50 system described herein with respect to the first embodiment and illustrated in FIGS. 2-3, 7A, 7B, 8B, and 16. The shims 40, 50 are shown in combination with the ninth embodiment in FIG. 20. The lower shim 50 encircles or abuts the hosel portion 30 and the upper shim 40 encircles or abuts the connection piece 300. When the shaft sleeve 20 is removed as discussed above, the fastener 60 is loosened such that the shims 40, 50 are permitted rotate with respect to each other and can be used to adjust the angle of the connection piece 300 with respect to the golf club head 100. Once the desired angle is attained, the fastener 60 is tightened and the shaft sleeve 20 is reattached to the connection piece 300 with the upper fastener 350. In an alternative embodiment, the shaft sleeve 20 does not need to be removed in order to use the shims 40, 50 to adjust the angles of the golf club head. In this embodiment, the fastener 60 is kept in a slightly loosened state to permit angular adjustments.

Figure 21A:
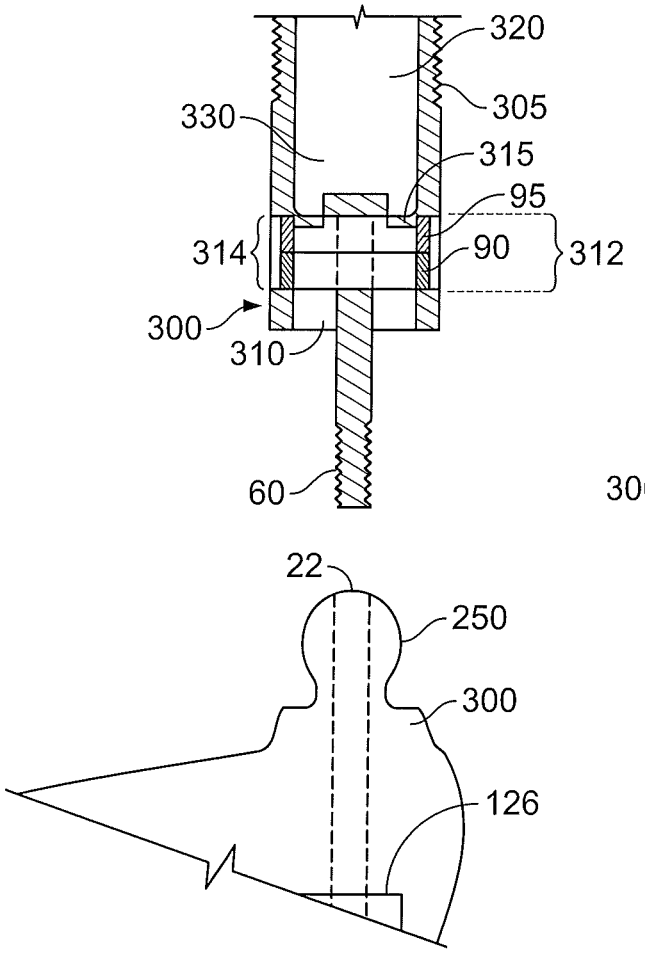
FIG. 21A is an exploded, cross-sectional view of a tenth embodiment of the present invention.
Figure 21B:
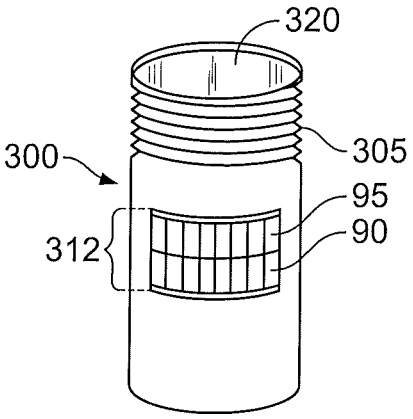
FIG. 21B is side, perspective view of the connector piece and wheels shown in FIG. 21A.

In a tenth embodiment, the assembly shown in FIGS. 19A and 19B is adjusted using the wheel system described herein and illustrated in FIGS. 10-12 and 17. As shown in FIGS. 21A and 21B, two eccentric wheels 90, 95 are disposed within the connection piece 300, which is sized to hold the wheels 90, 95 and has side openings 312, 314 to provide a user with access to the wheels 90, 95. The wheels 90, 95 of this embodiment function the same way as the wheels 90, 95 disclosed in FIGS. 10-12 and 17, moving the fastener 60 around a pivot surface (see FIG. 12) and ultimately adjusting the angle of the connection piece 300 with respect to the hosel portion 30. The shaft sleeve 20 generally should be removed from the connection piece 300 so that the fastener 60 may be loosened enough to allow the wheels 90, 95 to function. In an alternative embodiment, the fastener 60 is kept in a slightly loosened state so that shaft sleeve 20 does not need to be removed to use the wheels 90, 95 to adjust the angles of the golf club head 100.

The embodiments of the adjustable shaft and hosel assembly 10 described herein allow for universal angular adjustment, and also allow a user to remove the shaft sleeve from the hosel portion entirely so that a different shaft and/or shaft sleeve can be attached to the golf club head 100. Preferably, for each of the embodiments described herein, the angular adjustment range is a minimum of 0° to ≥2° from the reference axis 80. The assembly 10 of the present invention allows for torque forces to be transmitted between the body and the shaft, and visa-versa. The universal joint connection 25 or ball joint 250 also prevents shaft graphics and grip reminders on a golf club shaft from rotating out of orientation from the club head.

The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. Furthermore, the shims 40, 50, and fitting member 70 may be composed of lightweight materials, such as plastic, composite, aluminum, titanium alloy, and/or other such materials.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An adjustable golf club head comprising:

a body comprising a face, a sole, a crown, and a hosel comprising a hosel bore;

a shaft sleeve comprising a shaft sleeve axis, a joint connection having a threaded joint bore, and a shaft-receiving bore having a bore axis that is coaxial with the shaft sleeve axis;

a fitting member sized to fit within the hosel bore proximate the crown, the fitting member comprising a fitting member bore sized to receive the joint connection;

a first wheel having a first bore with a first diameter;

a second wheel having a second bore with a second diameter that is smaller than the first diameter; and a fastener comprising a head and a threaded body, wherein the threaded body engages the threaded joint bore, wherein the threaded body of the fastener fits within the first and second bores, wherein the fastener affixes the first and second wheels to the body, and wherein an angle between the shaft sleeve axis and the body can be adjusted by rotating the first and second wheels.

2. The adjustable golf club head of claim 1, wherein the joint connection protrudes from a lower portion of the shaft sleeve, and wherein the joint connection comprises at least two planar sides and at least two curved sides.

3. The adjustable golf club head of claim 2, wherein the fitting member can move within the hosel bore along a first axis, and wherein the joint connection can move within the fitting member along a second axis that is perpendicular to the first axis.

4. The adjustable golf club head of claim 1, wherein the golf club head is a driver head.

5. The adjustable golf club head of claim 1, wherein the shaft sleeve does not rotate around the bore axis by more than 5 degrees when a user makes angular adjustments.

6. The adjustable golf club head of claim 1, wherein the first and second wheels each comprise angle indicators on their exterior surfaces.

7. The adjustable golf club head of claim 1, wherein the first bore provides a pivot surface and the second wheel causes the threaded body of the fastener to move along the pivot surface when the second wheel is turned.

8. The adjustable golf club head of claim 1, wherein each of the first and second wheels is disposed within and accessible via an opening in the sole.

9. The adjustable golf club head of claim 1, wherein the first wheel is disposed closer to the head than the second wheel.

10. The adjustable golf club head of claim 9, wherein the first wheel is capable of moving the shaft sleeve 360° around a hosel axis.

11. The adjustable golf club head of claim 9, wherein a portion of the second wheel is disposed within the first bore.

12. The adjustable golf club head of claim 1, further comprising a shaft having graphics and a grip reminder, wherein the shaft is at least partially disposed within the shaft sleeve, and wherein the graphics and the grip reminder do not rotate by more than 5 degrees around the bore axis when the first or second wheels are adjusted.

* * * * *